US005303808A

United States Patent [19]

Hiortdahl

[11] Patent Number: 5,303,808

[45] Date of Patent: Apr. 19, 1994

[54] COIN CHUTE ASSEMBLY WITH ANTI-PRY COIN SLIDE

[75] Inventor: John C. Hiortdahl, Lothian, Md.

[73] Assignee: Hof Service Company, Inc., Silver Spring, Md.

[21] Appl. No.: 854,691

[22] Filed: Mar. 20, 1992

[51] Int. Cl.[5] ..... G07F 5/06

[52] U.S. Cl. ..... 194/202; 194/235

[58] Field of Search ..... 194/202, 203, 347, 349, 194/235, 238, 253, 259, 343

[56] References Cited

U.S. PATENT DOCUMENTS

| | | | |
|---|---|---|---|
| 1,570,032 | 1/1926 | Baldner | 194/243 X |
| 2,947,186 | 8/1960 | Greenwald . | |
| 3,872,958 | 3/1975 | Greenwald et al. . | |
| 4,042,089 | 8/1977 | Mellinger | 194/203 |
| 4,131,190 | 12/1978 | Gitlin . | |
| 4,350,240 | 9/1982 | Gitlin et al. . | |
| 4,501,349 | 2/1985 | Giepen | 194/235 |
| 4,502,584 | 3/1985 | Lambiris . | |
| 4,515,262 | 5/1985 | Wilfong et al. . | |
| 4,588,064 | 5/1986 | Monfredi . | |
| 4,651,861 | 3/1987 | Lambiris . | |
| 4,828,096 | 5/1989 | Gitlin et al. . | |
| 4,881,630 | 11/1989 | Kobayashi et al. | 194/203 |
| 5,074,396 | 12/1991 | Gitlin et al. . | |

*Primary Examiner*—F. J. Bartuska

*Attorney, Agent, or Firm*—Roylance, Abrams, Berdo & Goodman

[57] ABSTRACT

A coin chute assembly having an anti-pry mechanism. A gate, pivotally mounted on a baffle, pivots upwardly to allow passage of the coins on the inward stroke of the coin slide. On retraction of the coin slide, the gate abuts the peripheral edges of the coins to form a stop, thereby preventing retraction of the slide. A plurality of gate elements may be employed, each having a different length.

24 Claims, 4 Drawing Sheets

COIN CHUTE ASSEMBLY WITH ANTI-PRY COIN SLIDE

FIELD OF THE INVENTION

The invention relates to a coin chute having an anti-pry feature which prevents damage to the chute assembly and prevents a tampering customer from receiving a free start. In particular, the coin chute assembly includes a gate pivotally mounted on a baffle of the coin chute housing. The gate freely floats and is positioned within the path of the coins to allow only one-way passage of the coins. The machine associated with the coin chute assembly will not be activated until after the coins pass the gate. The coin slide cannot be retracted prior to discharge of the coins due to abutment of the coins against the gate.

BACKGROUND OF THE INVENTION

A coin chute assembly may typically include a stationary housing having a horizontally oriented guide track, a vertically oriented mounting plate and a baffle position over a set of blocking dogs. A coin slide is slidably mounted in the guide track of the housing to move into and retract from the housing. Slots provided in the upper surface of the coin slide support a requisite number and denomination of coins in a vertical, longitudinally oriented position. Without the coins the coin slide is prevented from moving inwardly beyond a point where the blocking dogs catch a bar associated with the coin slide. The coins coact with a sizing block mounted in a forward end of the baffle to push the blocking dogs downwardly, thus facilitating further inward movement of the coin slide. Eventually, an extension mounted on the coin slide triggers an "ON" switch or other structure provided for activation of the machine.

After the coins pass under the sizing block a pawl mounted in the side of the coin slide comes into cooperative engagement with a rack mounted on the side of the guide track. The pawl and rack provide a ratchet mechanism that prevents the coin slide from being retracted until after the slide moves inwardly to a point where the coins fall into a coin box.

Generally, at the point where the coin slide is extended far enough to engage the start mechanism of the associated machine, such as a dryer, washer, vending machine, etc., the coins have not yet dropped through the slots in the coin slide and into the coin box. At this point, a tampering customer can pry backwards on the handle of the coin slide, using the top edge of the meter case for leverage. After prying with sufficient force, the coin slide pawl is damaged or broken so that the coin slide can be freely reciprocated. Once this occurs, the "customer" can receive a free start by pushing the coin slide inwardly sufficiently to activate the machine, without reaching the point where the coins fall into the coin box. Then, the slide is retracted to retrieve the coins. The result of the foregoing is economic loss to the vendor due to physical damage to the coin chute assembly. Moreover, the free starts which follow exacerbate the economic loss.

U.S. patents showing in general coin chute assemblies and anti-tampering features include U.S. Pat. No. 2,947,186 to Greenwald; U.S. Pat. No. 3,872,958 to Greenwald et al; U.S. Pat. No. 4,131,190 to Gitlin; U.S. Pat. No. 4,502,584 to Lambiris; U.S. Pat. No. 4,588,064 to Monfredi; U.S. Pat. No. 4,651,861 to Lambiris; and U.S. Pat. Nos. 4,828,096 and 5,074,396 Gitlin et al.

SUMMARY OF THE INVENTION

A primary object of the present invention is to provide a coin chute assembly having an anti-pry feature, wherein the coin slide cannot be retracted until after the coins are deposited in the coin box.

Another object of the present invention is to provide a coin chute assembly which prevents damage to the coin slide ratchet mechanism.

Another object of the present invention is to provide a coin chute assembly having an anti-pry feature which prevents free starts.

The foregoing objects are basically attained by providing a coin chute assembly including a housing having a guide track, at least one blocking dog movably mounted on the housing, a coin slide slidably mounted in the housing guide track for movement into and retraction from the housing, and having an upper surface, at least one coin slot in vertical alignment with the blocking dog, an abutment positioned normally in a path to engage the blocking dog when the coin slide is pushed inwardly to a first blocking position, a baffle mounted on the housing and having a forward end, a contoured rearward end shaped to direct the coin towards a coin discharge, an upper wall and a pair of opposite side walls, a sizing block mounted in the forward end of the baffle and cooperating with the coin to move the blocking dog out of the path of the abutment immediately prior to the coin slide reaching the first blocking position, and gate means, cooperating with the coin, for preventing retraction of the coin slide.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawing which form a part of this original disclosure.

DETAILED DESCRIPTION OF THE DRAWINGS

Figure 1:
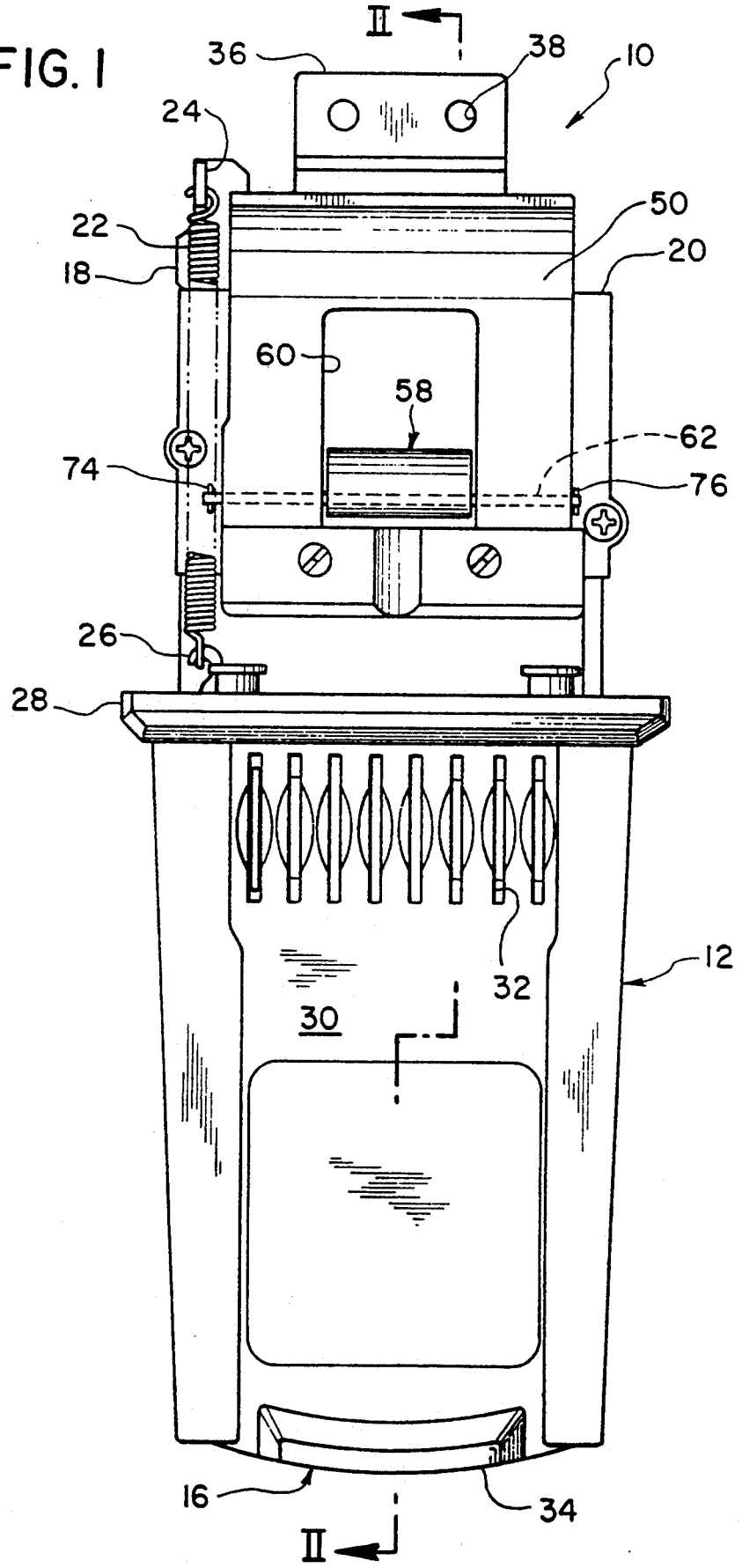
FIG. 1 is a top plan view of a coin chute assembly according to a preferred embodiment of the present invention.
Figure 2:
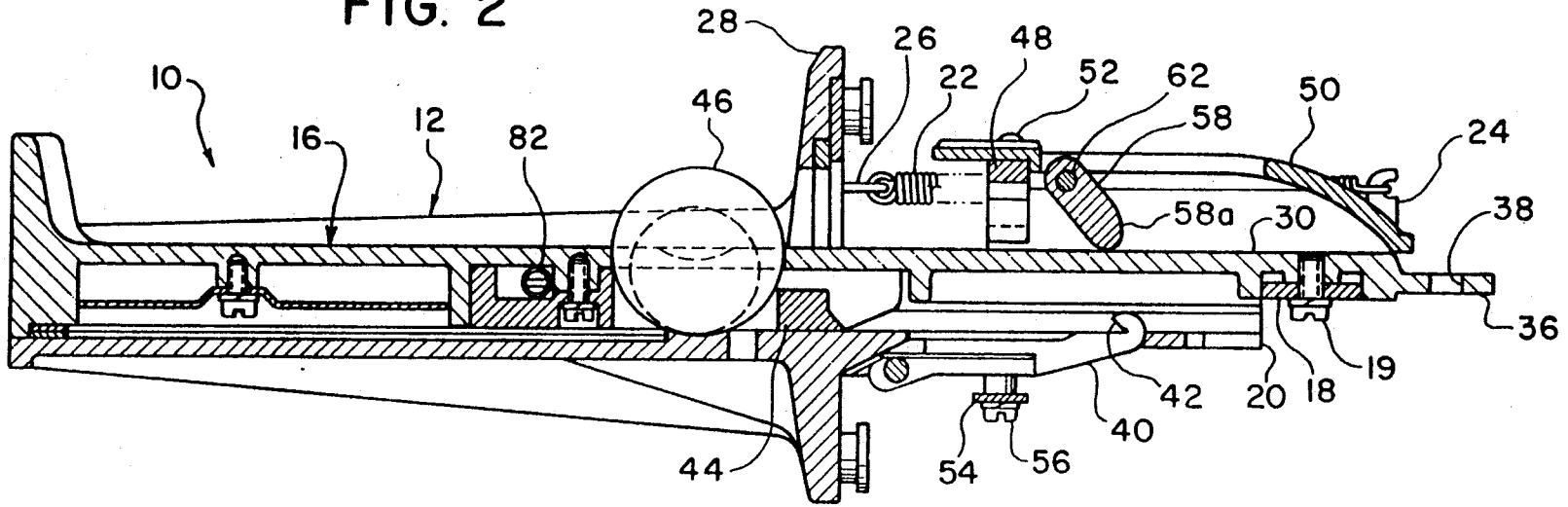
FIG. 2 is a vertical sectional view of the coin chute assembly of FIG. 1 taken along line II—II with the coin slide in its initial, outer most position.
Figure 3:
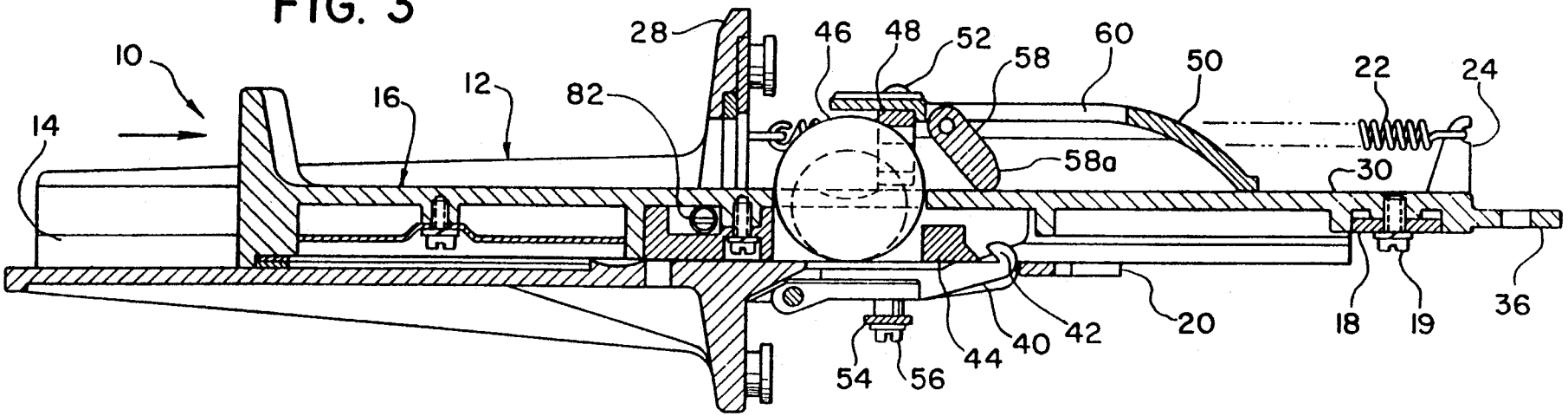
FIG. 3 is the same sectional view as FIG. 2, with the coin slide moved inwardly to a position just before reaching the sizing block.
Figure 4:
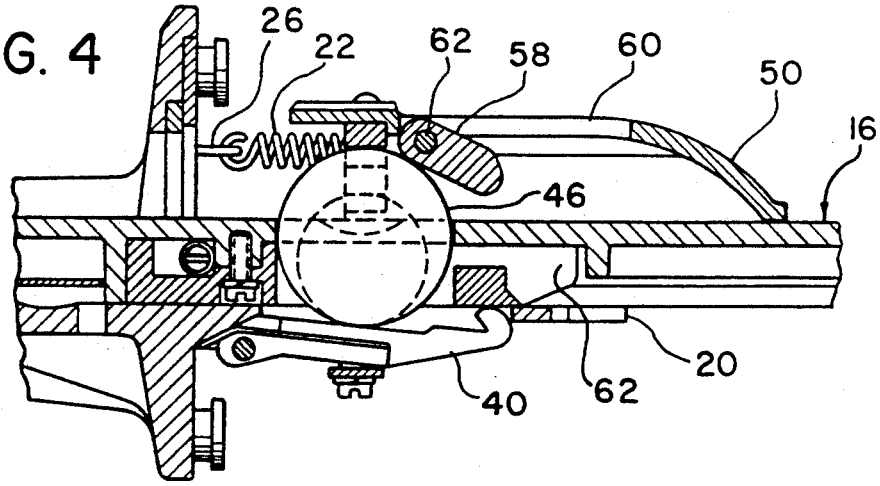
FIG. 4 is the same sectional view as FIG. 2, only partially illustrated, with the coin slide moved inwardly to a position where the coin engages the sizing block.

FIGS. 1-6 illustrate a coin chute assembly having the basic features and functions as that described in U.S. Pat. No. 4,502,584 to Lambiris, the entire disclosure of which is incorporated herein by reference. The coin chute assembly, generally referred to by the numeral 10 includes a housing 12 provided with a guide track 14. The guide track 14 slidably receives a coin slide 16, illustrated in the fully retracted position in FIG. 1. Further retraction is prevented by a stop plate 18, mounted by screws 19 on an inner end portion of the coin slide 16, which abuts the inner end 20 of the housing 12. A spring 22 extends between a post 24 of the stop plate 18 and a hook 26 connected to a mounting plate 28 integral with the housing 12. The mounting plate 28 separates the housing into an exterior portion, located outside the "shoe-box" that contains the coin box, and an interior portion located within the shoe-box. The shoe-box or other structure is normally provided to mount the housing and protect the coin box and inner workings of the coin chute assembly. The coin slide 16 is partially exterior and partially interior and moves back and forth as appropriate.

The coin slide 16 has an upper surface 30 and a plurality of coin slots 32 formed in lateral alignment with each other. The slots 32 extend through the coin slide 16 so that the requisite number and denomination of coins are supported in the slots 32 in a vertical and longitudinal orientation. As more fully explained in U.S. Pat. No. 4,502,584 a combination of slots can be selected to feed the required amount of coins necessary to start the machine.

A handle 34 is formed at one end of the coin slide 16, and a mounting plate 36 extends from the opposite end. The mounting plate 36 includes mounting holes 38 for mounting a slide extension (not shown) used to activate an associated machine.

The coin slots 32 are in vertical alignment with a corresponding number of blocking dogs 40. Each blocking dog has a catch 42 formed at its distal end. The catch 42 is positioned in the path of the coin slide 16 so as to engage an abutment 44, in the form of a cross bar, carried by the coin slide 16. The blocking dogs 40 thus normally prevent the coin slide 16 from sliding inwardly beyond the point where the blocking dogs 40 engage the abutment 44. This prevents the slide extension from reaching a timer or switch of the machine, and thus prevents free starting.

When coins 46 are loaded into respective ones of the slots 32, the blocking dogs 40 can be disengaged to permit full inward movement of the coin slide 16. The coins 46 cooperate with a sizing block 48 removably mounted in the forward open end of a baffle 50 by screws 52. The blocking dogs 40 are pivotally mounted in the coin slide 16 and spring biased upwardly to the engagement position. When the coins 46 pass between the sizing block 48 and the blocking dogs 40, the blocking dogs 40 are forced downwardly since the height of the coins 46 exceeds the distance between the sizing block 18 and the blocking dogs 40. The sizing block 48 is fixedly connected to the coin slide 16 so as to impart pivotal movement of the blocking dogs 40 in cooperation with the coins 46. A bar 54, mounted by screws 56, prevents excessive downward movement of the blocking dogs 40.

Once the coin slide 16 is moved inwardly to a point where the coins 46 clear the sizing block 48, a pawl 51 rotatably mounted in the coin slide 16 comes into engagement with a rack 53 so as to create a ratchet mechanism. The ratchet mechanism allows further inward movement of the coin slide but not retraction. Once the last tooth of the pawl 51 clears the rack 53, the ratchet will permit retraction, but this occurs after the coins are discharged to the coin box. The pawl 51 is spring biased by a spring 82 (FIGS. 2 and 3) to return to a radially outward position illustrated in FIG. 1. The pawl 51, mounted on a fixed pin 55, pivots about a vertical axis as it moves over the rack 53.

Figure 5:
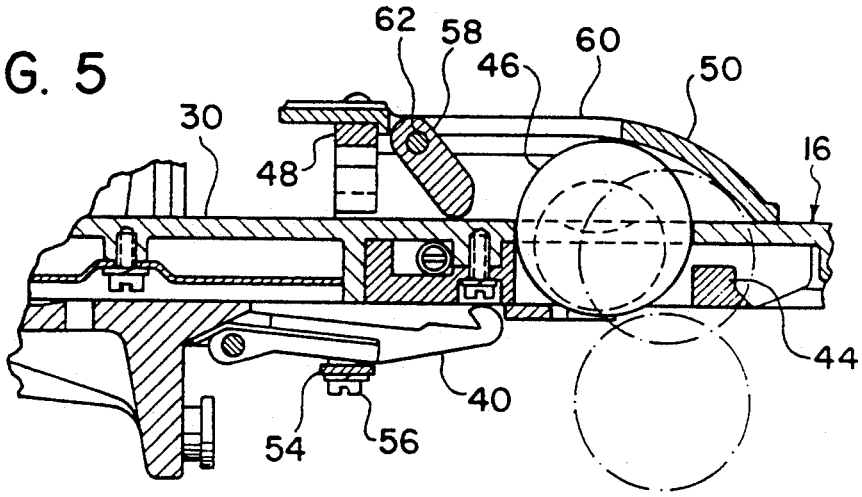
FIG. 5 is the same sectional view as FIG. 2, only partially illustrated, with the coin slide moved inwardly to a coin discharge position.

The baffle 50 directs coins, after passing by the sizing block 48, towards a coin box (not shown) normally located under the inner end 20 of the housing 12. Once the coin slots 32 pass the inner end 20, as seen in FIG. 5, the coins 46 are free to drop through the slots and into the coin box. Generally, the slide extension will cause activation of the machine just before the coins 46 are discharged into the coin box.

A gate 58 is pivotally mounted in an opening 60 of the baffle 50. The gate 58 pivots about a horizontal pivot axis disposed transversely of the sliding direction of the coin slide 16. A pivot shaft 62 is mounted in a pair of aligned holes 64 formed in opposite side walls of the baffle 50. A second pair of aligned holes 66 are optionally provided to shift the pivot axis rearwardly if necessary (for example, if smaller coins are used). The shaft 62 passes through a hole 68 formed through a proximal end portion of the gate so that the gate 58 freely swings on the shaft 62. A pair of washers 70 and 72 are mounted on the shaft 62 to provide spacing between the peripheral edge of the baffle opening 60 and the opposite end faces of the gate 58. A pair of C-clips 74 and 76 engage annular grooves 78 and 80 provided respectively at opposite end portions of the shaft 62 to retain the shaft in its mounting holes.

Figure 8:
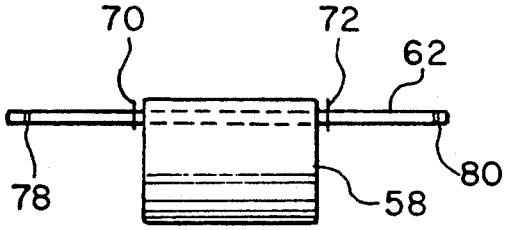
FIG. 8 is a top view of a gate sub-assembly of the coin chute assembly of FIG. 1.
Figure 9:
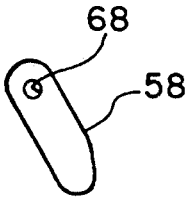
FIG. 9 is an end view of the gate of FIG. 8.

In top plan view as seen in FIG. 8, the gate 58 is a generally rectangular plate with a forward flat surface 58*a* having two parallel teeth 58*b* and 58*c* extending integrally therefrom substantially coextensive with the rest of the gate 58. Surface 58*a* is tapered rearwardly and upwardly at an angle of about 70° from the longitudinal axis of the gate.

The gate 58 cooperates with the coins 46 to prevent retraction of the coin slide 16 until the coins are discharged through the coin slot 32. The gate 58 freely floats with its distal end formed by teeth 58*b* and 58*c* normally in sliding contact with the upper surface 30 of coin slide 16 and is inclined about 30° from the surface 30. The coins 46, when passing under the gate, impart pivotal upward movement to the gate 58 which allows the coins to pass thereunder. Afterwards, the gate pivots downwardly, under the force of gravity, behind the coins so that, if the coin slide 16 is retracted, the inwardly facing surface 58*a* of the gate 58 abuts the peripheral edge of the coin or coins 46 and thus prevents further retraction of the coin slide. In other words, the gate is positioned along the coin path such that the machine will not be activated until after the coins pass under and clear the gate 58 which then pivots downwardly. Further inward movement of the coin slide will cause activation of the machine and discharge of the coins, but retraction is prevented by the gate 58. Thus, the ratchet pawl 51 is spared from excessive prying forces when tampering occurs. Instead, the prying force is resisted by the gate and coin abutment.

Figure 6:
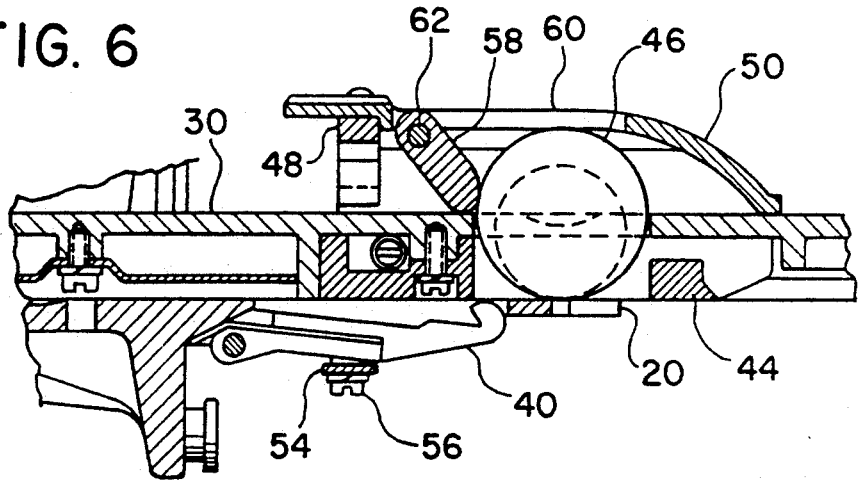
FIG. 6 is the same sectional view as FIG. 2, only partially illustrated, with the coin slide moved to an abutting position with the gate.
Figure 7:
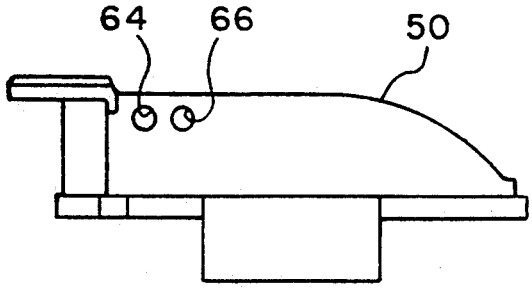
FIG. 7 is a side elevational view of the baffle of the coin chute assembly of FIG. 1.

The gate flat surface 58*a* is angled substantially 80° rearwardly and downwardly relative to the upper surface 30 of the coin slide 16 when the gate contacts the upper surface 30 as seen in FIGS. 2, 3, 5 and 6. As shown in FIG. 6, the peripheral edge of the coin 46 abuts the flat surface 58*a* when the gate contacts the upper surface 30. Since the gate 58 is only slightly angled acutely with respect to vertical, the gate is prevented from pivoting clockwise in FIGS. 2–6 when the coin slide is retracted. The coins 46 preferably do not expose more than one half their diameter above the upper surface 30 of the coin slide 16 to prevent the gate from lifting the coins upwardly. The coins 46 are prevented from moving downwardly, at the point where the gate 58 abuts the coins 46, by the housing 12.

Figure 10:
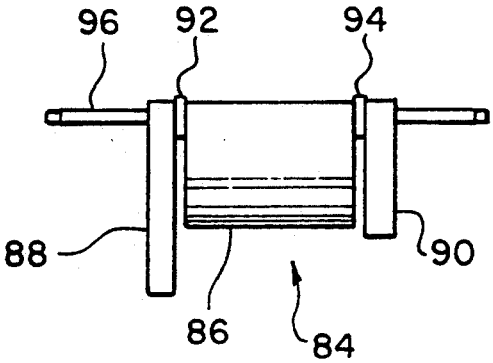
FIG. 10 is a top view of a gate sub-assembly according to another embodiment of the present invention.
Figure 11:
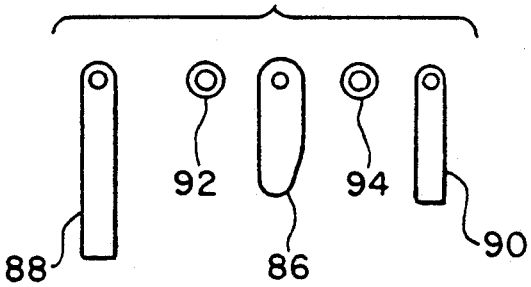
FIG. 11 is an end view of the individual components of the sub-assembly of FIG. 10.

Embodiment of FIGS. 10 and 11

The gate may have more than one component. As shown in FIGS. 10 and 11, a gate assembly 84 includes a central gate element 86, and two flanking gate elements 88 and 90, each of different length from each other and from the central gate element 86. The flanking elements 88 and 90 are separated by elastomeric washers 92 and 94 which act as bushings to permit relative pivotal movement between the different gate elements when mounted on pivot shaft 96. The pivot shaft is mounted in the baffle 50 as in the previous embodiment. In operation, the distal end portions of the various gate elements slide along the upper surface of the coin slide 16. The overall length of each gate element may be selected so that coins of different diameters can be simultaneously in abutment with corresponding ones of the gate elements. For example, a quarter has a greater diameter than a dime; the peripheral edge of the dime would thus be further from the pivot axis of the gate assembly 84 than would the quarter. Therefore, the gate element engaging the dime, such as element 88 would be longer than the gate element engaging the quarter or quarters, such as gate element 86.

An alternative function of the plural gate elements is that if coins of the same size are used, a three-staged abutment sequence is created whereby as the coin slide is pushed further inwardly, progressively longer gate elements are positioned behind the coins. Thus, the coin slide 16 is prevented from being retracted from progressively inward positions.

While various embodiments have been chosen to illustrate the invention, it will be understood by those skilled in the art that various changes and modifications can be made therein without departing from the scope of the invention as defined in the appended claims.

What is claimed is:

1. A coin chute assembly comprising:

a housing having a guide track;

at least one blocking dog movably mounted to the housing;

a coin slide slidably mounted in the housing guide track for movement between an outer starting position and an inner coin discharge position, and having an upper surface, at least one coin slot in vertical alignment with the blocking dog, and an abutment positioned normally in a path to engage the blocking dog, said coin slide maintaining at least one coin in a vertical position for substantially parallel movement with said coin slide until said coin slide reaches the inner coin discharge position permitting the coin to move transversely relative to the movement of said coin slide;

a baffle mounted on the housing and having a forward end, a rearward end, an upper wall and a pair of opposite side walls;

a sizing block mounted in the forward end of the baffle and cooperating with the coin to move the blocking dog out of the path of the abutment; and gate means, movably coupled to said housing to cooperate with the coin, for preventing retraction of the coin slide prior to the coin slide reaching the coin discharge position, said gate means being movably coupled above said coin slide to move upwardly to permit passage of the coin thereunder and to move downwardly after passage of the coin thereunder to abut a peripheral edge of the coin to prevent retraction of the coin slide.

2. A coin chute assembly according to claim 1, wherein the gate means includes a gate element having a distal end portion in sliding contact with the upper surface of the coin slide.

3. A coin chute assembly according to claim 1, wherein the gate means comprises at least one gate element pivotally mounted on the baffle.

4. A coin chute assembly according to claim 3, wherein the gate element includes a proximal end portion having a mounting hole formed therein, and a distal end portion normally in sliding contact with the upper surface of the coin slide.

5. A coin chute assembly according to claim 4, further comprising a pivot shaft mounted transversely in an upper, forward portion of the baffle and passing through the mounting hole of the gate element

6. A coin chute assembly according to claim 5, wherein the baffle includes an opening formed in the upper wall, said gate means being pivotal within the opening.

7. A coin chute assembly according to claim 1, wherein the baffle includes an opening formed in the upper wall, said gate means including at least one gate element pivotally movable in the opening of said baffle.

8. A coin chute assembly according to claim 1, wherein the gate means includes at least one gate element pivotally connected to the baffle and being pivotal upwardly to permit passage of the coin thereunder, and being pivotal downwardly after passage of the coin, and being in abutment with a peripheral edge of the coin when the coin slide and thus the coin is retracted following downward pivotal movement of the gate element.

9. A coin chute assembly according to claim 1, wherein the baffle includes at least two pairs of aligned mounting holes formed in the opposite side walls, and the gate means include a pivot shaft mounted in one of the at least two pairs of mounting holes and at least one gate element pivotally carried by the mounting shaft.

10. A coin chute assembly according to claim 1, wherein the gate means comprises a plurality of gate elements pivotally mounted on the baffle.

11. A coin chute assembly according to claim 10, wherein the plurality of gate elements includes a central gate element having a length and two flanking gate elements, each being disposed on opposite sides of the central gate element and each having a length different from each other and different from the length of the central gate element.

12. A coin chute assembly according to claim 11, further comprising a pivot shaft passing through proximal end portion of each gate element and being mounted in a pair of mounting holes formed in the opposite side walls of the baffle.

13. An apparatus for preventing premature retraction of a coin slide, comprising:

a sliding element and an associated stationary element, the sliding element carrying at least one coin in a vertical position along a linear path for movement between an outer starting position and an inner discharge position, and the stationary element having an interior portion and an exterior portion;

at least one gate element movably connected to the interior portion of the stationary element above the sliding element and having a distal end portion in sliding contact with the sliding element and being positioned in the linear path of the coin to move upwardly to permit passage of the coin thereunder when the sliding element is pushed inwardly and to move downwardly after the coin has passed thereunder, the retraction of the sliding element being prevented by abutment of the gate element against the coin.

14. An apparatus according to claim 13, further comprising a pivot shaft mounted horizontally and transversely on the stationary element, said gate element having a proximal end portion having a hole formed therein for receiving a pivot shaft.

15. An apparatus according to claim 13, wherein the at least one gate element includes a central gate element, and two flanking gate elements, one being disposed on each opposite side of the central gate element, each of the two flanking gate elements and the central gate element having a different length.

16. An apparatus according to claim 13, wherein the stationary element includes a baffle having an upper surface, and a pair of opposite side walls having at least one pair of mounting holes formed therein.

17. An apparatus according to claim 16, further comprising a pivot shaft mounted in the pair of mounting holes, said gate element being pivotally carried by said pivot shaft.

18. An apparatus according to claim 15, further comprising first and second washers disposed respectively between the flanking gate elements and the central gate element.

19. An anti-pry assembly adapted to be coupled to an existing coin slide, comprising gate means, adapted to be movably coupled above a linear coin path of the coin slide, for preventing retraction of the coin slide by engaging a coin prior to discharge of the coin; and mounting means for movably coupling said gate means to the coin slide for movement of said gate means upwardly out of the coin path upon engaging the coin to permit passage of the coin underneath said gate means in one direction along the coin path, and for movement of said gate means downwardly back into the coin path after the coin passes underneath said gate means to prevent passage of the coin in the opposite direction along the coin path, said gate means and said mounting means being sized to be coupled to an existing coin slide.

20. An anti-pry assembly according to claim 19, further comprising;

baffle means, adapted to be coupled to the coin slide, for directing at least one coin positioned in the coin slide along the coin path to a coin box.

21. An anti-pry assembly according to claim 20, wherein said mounting means includes at least one pivot shaft pivotally coupled between said baffle means and said gate means.

22. An anti-pry assembly according to claim 20, wherein said gate means includes a plurality of gate elements pivotally mounted on said baffle means.

23. An anti-pry assembly according to claim 22, wherein said plurality of gate elements includes a central gate element having a predetermined length and two flanking gate elements, each of said flanking gate elements being disposed on opposite sides of said central gate element and having a length different from said length of said central gate element.

24. An anti-pry assembly, according to claim 21, wherein said baffle means has an upper wall with an opening therein, said gate means being pivotal mounted by said pivot shaft in said opening.

* * * * *